US008726671B2

(12) United States Patent
Cai et al.

(10) Patent No.: US 8,726,671 B2
(45) Date of Patent: May 20, 2014

(54) OPERATION OF A COMBUSTOR APPARATUS IN A GAS TURBINE ENGINE

(75) Inventors: Weidong Cai, Oviedo, FL (US); Clifford E. Johnson, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 979 days.

(21) Appl. No.: 12/836,033

(22) Filed: Jul. 14, 2010

(65) Prior Publication Data

US 2012/0011855 A1 Jan. 19, 2012

(51) Int. Cl.
*F02C 9/54* (2006.01)
*F02C 9/20* (2006.01)

(52) U.S. Cl.
USPC ..... 60/773; 60/776; 60/39.27

(58) Field of Classification Search
USPC ..... 60/734, 39.281, 737, 746, 747, 748, 60/786–790, 772, 773, 776, 39.23, 39.27
See application file for complete search history.

(56) References Cited

U.S. PATENT DOCUMENTS 4,292,801 A 10/1981 Wilkes et al.
4,766,721 A * 8/1988 Iizuka et al. ..... 60/747
5,044,152 A * 9/1991 Hoizumi et al. ..... 60/773
5,836,164 A * 11/1998 Tsukahara et al. ..... 60/737
6,047,550 A 4/2000 Beebe
6,996,991 B2 2/2006 Gadde et al.
7,107,773 B2 9/2006 Little
7,197,877 B2 4/2007 Moraes
7,269,953 B2 9/2007 Gadde et al.
7,509,811 B2 * 3/2009 Chen et al. ..... 60/776
7,610,745 B2 * 11/2009 Fujii et al. ..... 60/746
2009/0180939 A1 * 7/2009 Hagen et al. ..... 422/194
2009/0272116 A1 11/2009 Bland
2011/0167833 A1 * 7/2011 Kawai et al. ..... 60/791

* cited by examiner

*Primary Examiner* — Ted Kim

(57) ABSTRACT

A method of transitioning from a first operating mode to a second operating in a gas turbine engine. An amount of fuel provided to a primary fuel injection system of the combustor apparatus is reduced. An amount of fuel provided to a secondary fuel/air injection system of the combustor apparatus is reduced, wherein the secondary fuel/air injection system provides fuel to a secondary combustion zone downstream from a main combustion zone. A total amount of air provided to the combustor apparatus is reduced, wherein portions of the air are provided to each of the injection systems. Upon reaching operating parameters corresponding to the second operating mode, the amount of fuel provided to the primary fuel injection system is increased, the amount of fuel provided to the secondary fuel/air injection system is reduced, and the total amount of air provided to the combustor apparatus is increased.

19 Claims, 4 Drawing Sheets

FIG. 1
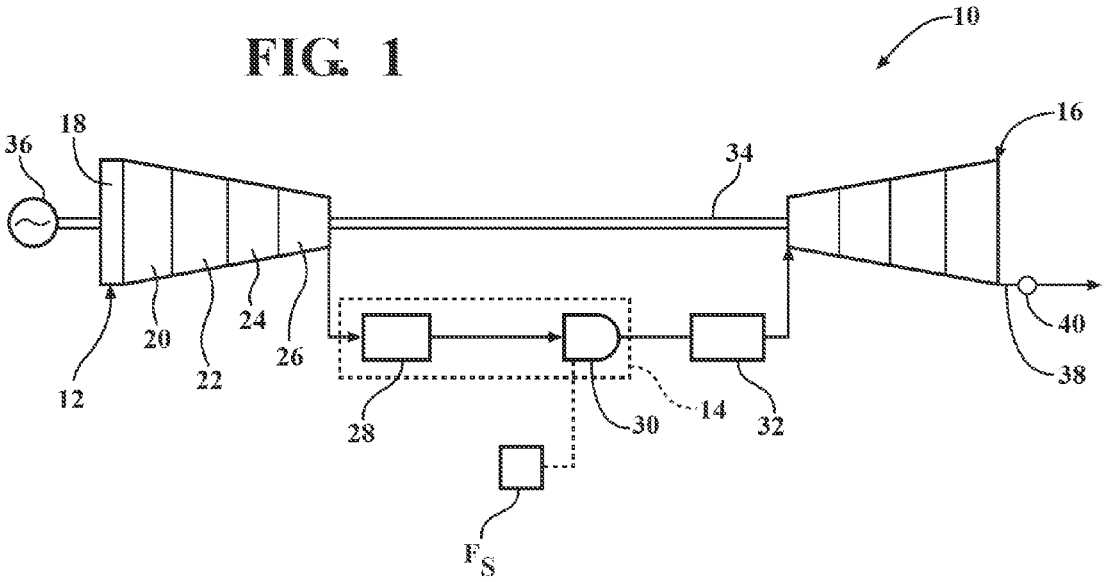
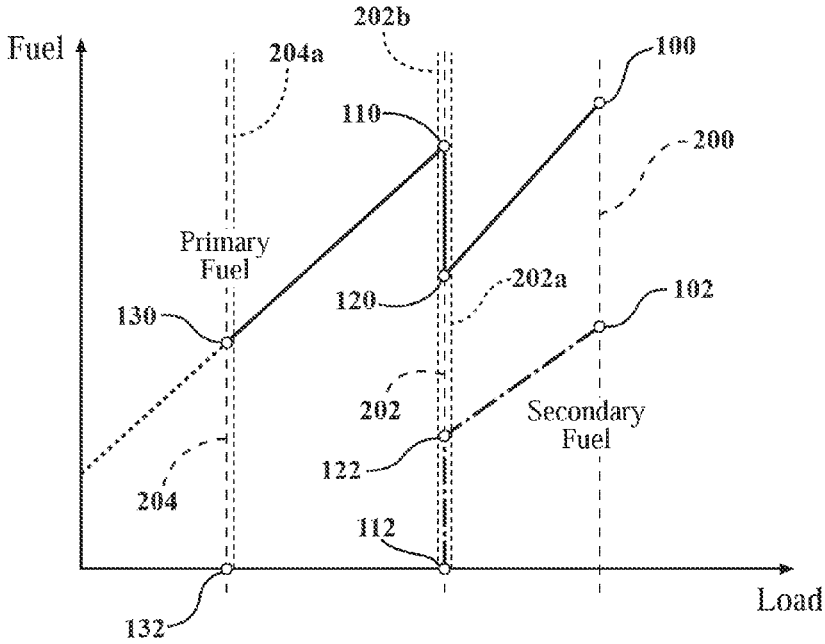
FIG. 4

OPERATION OF A COMBUSTOR APPARATUS IN A GAS TURBINE ENGINE

FIELD OF THE INVENTION

The present invention relates to operation of a combustor apparatus in a gas turbine engine.

BACKGROUND OF THE INVENTION

Gas turbine power plant operators are often faced with an economic dilemma of whether or not to operate their plants during low power demand times. By operating continuously, the plant will be available to quickly produce base load power when the power demand becomes high. The plant maintenance cost will also be reduced with fewer plant starts and stops. However, operation during these low power demand times often results in negative profit margins, or losses, for the plant operator because the low cost of power does not offset the cost of fuel.

The logical solution for the plants that choose to operate continuously is to minimize the losses by minimizing fuel consumption during operation at minimum power demand. Industrial gas turbine engines are designed to operate at a constant design turbine inlet temperature under any ambient air temperature (i.e., the compressor inlet temperature). This design turbine inlet temperature allows the engine to produce maximum possible power, known as base load or a full load operating mode. Any reduction from the maximum possible base load power, such during a plant turn down, is referred to as a part load operating mode. That is, part load entails all engine operation from 0% to 99.9% of base load power. However, operation of the plant is restricted by its exhaust gas emissions permit. Since emissions such as nitrous oxides (NOx) and carbon monoxide (CO) typically increase on a volumetric basis as the gas turbine power decreases, this limits how much the plant can turn down, or reduce power, during the low power demand times.

In particular, part load operation may result in the production of high levels of carbon monoxide (CO) during combustion. One known method for reducing part load CO emissions is to bring the combustor exit temperature or the turbine inlet temperature near that of the base load design temperature. It should be noted that, for purposes of this disclosure, the terms combustor exit temperature and turbine inlet temperature are used interchangeably. In actuality, there can be from about 30 to about 80 degrees Fahrenheit difference between these two temperatures due to, among other things, cooling and leakage effects occurring at the transition/turbine junction. However, with respect to aspects of the present invention, this temperature difference is insubstantial.

To bring the combustor exit temperature closer to the base load design temperature, the mass flow of air through a turbine engine can be restricted by closing compressor inlet guide vanes (IGV), which act as a throttle at the inlet of a compressor for the gas turbine engine. When the IGVs are closed, the trailing edges of each of the vanes rotate closer to the surface of an adjacent vane, thereby effectively reducing the available throat area. Reducing the throat area reduces the flow of air which the first row of rotating blades can draw into the compressor. Lower flow to the compressor leads to a lower compressor pressure ratio being established in the turbine section of the engine. Consequently, the compressor exit temperature decreases because the compressor does not input as much energy into the incoming air. Also, the mass flow of air through the turbine decreases, and the combustor exit temperature increases.

While controlling emissions during plant turn down is effectively controlled by closing the IGVs, this has limited capability. Constant speed compressors, such as those used for industrial gas turbines, have limitations on the amount that the mass air flow into the compressor may be reduced using the IGVs before running into structural and/or aerodynamic issues. Further, CO emissions increase rapidly as gas turbine engine load is reduced below approximately 60%. Once the IGVs have been closed to their limit, and the engine's exhaust temperature limit has been reached, then power typically may be reduced only by decreasing turbine inlet temperature. Turbine inlet temperature reduction corresponds to a decrease in the combustion system's primary zone temperature, resulting in CO and unburned hydrocarbons (UHC) being produced due to quenching of the combustion reactions in the turbine hot gas path.

SUMMARY OF THE INVENTION

In accordance with a first embodiment of the present invention, a method is provided of operating a combustor apparatus in a turbine engine. The method comprises transitioning from a first operating mode to a second operating mode corresponding to a lesser load than the first operating mode. An amount of fuel provided to a primary fuel injection system of the combustor apparatus is reduced, wherein the primary fuel injection system provides fuel to a main combustion zone. An amount of fuel provided to a secondary fuel/air injection system of the combustor apparatus is reduced, wherein the secondary fuel/air injection system provides fuel to a secondary combustion zone downstream from the main combustion zone. A total amount of air provided to the combustor apparatus is reduced, wherein a first portion of the air is provided to the primary fuel injection system and a second portion of the air is provided to the secondary fuel/air injection system. Upon reaching operating parameters corresponding to the second operating mode, the amount of fuel provided to the primary fuel injection system is increased, the amount of fuel provided to the secondary fuel/air injection system is reduced to a predetermined value, and the total amount of air provided to the combustor apparatus is increased.

In accordance with a second embodiment of the invention, a method is provided of operating a combustor apparatus in a turbine engine. The method comprises transitioning from a full load operating mode to a part load operating mode. An amount of fuel provided to a primary fuel injection system of the combustor apparatus is reduced, wherein the primary fuel injection system provides fuel to a main combustion zone. An amount of fuel provided to a secondary fuel/air injection system of the combustor apparatus is reduced, wherein the secondary fuel/air injection system provides fuel to a secondary combustion zone downstream from the main combustion zone. A total amount of air provided to the combustor apparatus is reduced, wherein a first portion of the air is provided to the primary fuel injection system and a second portion of the air is provided to the secondary fuel/air injection system, and wherein the second portion of air is distributed to the secondary combustion zone via at least one outlet of the secondary fuel/air injection system located at the secondary combustion zone. Upon reaching operating parameters corresponding to the part load operating mode, the amount of fuel provided to the primary fuel injection system is increased, the amount of fuel provided to the secondary fuel/air injection system is reduced to a predetermined value, and the total amount of air provided to the combustor apparatus is increased.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

FIG. 1 is a schematic diagram of a gas turbine engine according to an embodiment of the invention;

FIG. 4 is a graph illustrating amounts of fuel that are delivered to injection systems of a combustor apparatus according to an embodiment of the invention;

DETAILED DESCRIPTION OF THE INVENTION

Figure 2:
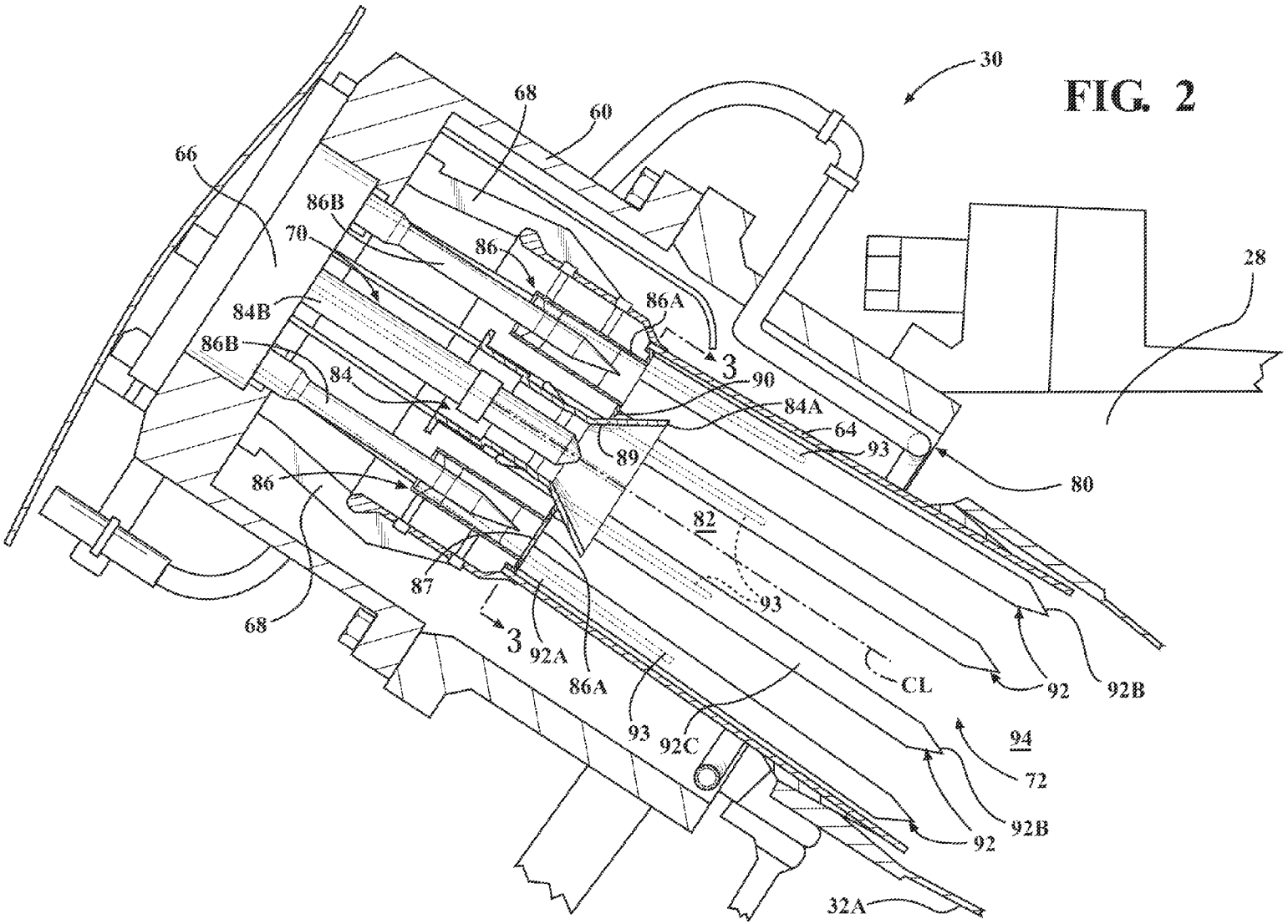
FIG. 2 is a sectional view of a combustor apparatus of the gas turbine engine illustrated in FIG. 1.

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Referring to FIG. 1, a gas turbine engine 10 is schematically shown. The engine 10 includes a compressor section 12, a combustion section 14, and a turbine section 16. Inlet air is permitted to enter the compressor section 12 through one or more inlet guided vanes (IGVs) 18, which can be opened and closed or otherwise adjusted to control the mass flow of air into the compressor section 12. It should be understood that the compressor section 12 of the engine 10 can have other assemblies that provide for flow control, including, for example, variable stator vanes. The inlet air is pressurized in the compressor section 12 and then is directed to the combustion section 14. As is known in the art, the compressor section 12 can have one or more stages such as front stages 20, forward stages 22, middle stages 24, and rear stages 26.

The combustion section 14 includes a combustor shell 28 for receiving the compressed air from the compressor section 12, also known as combustor shell air, and one or more combustor apparatuses 30 for receiving and mixing fuel with the combustor shell air and igniting the air/fuel mixture(s) to produce hot working gases, also known as combustion gas.

The combustion gas flows out of the combustion section 14 to the turbine section 16 via a transition section 32 comprising a transition duct 32A (see FIG. 2) associated with each combustor apparatus 30. The combustion gas is expanded in the turbine section 16 to provide rotation of a turbine rotor 34. The rotation of the turbine rotor 34 is used to power a generator 36 coupled to the turbine rotor 34, as illustrated in FIG. 1. The combustion gas is then exhausted from the engine 10 via a turbine exhaust 38, which may include one or more exhaust sensors 40 for monitoring emissions of the combustion gas.

As noted above, the combustion section 14 may comprise one or more combustor apparatuses 30. According to one aspect of the invention, the combustion section 14 comprises a plurality of combustor apparatuses 30 spaced circumferentially apart about the turbine rotor 34. Referring to FIG. 2, one of the combustor apparatuses 30 of the combustion section 14 is shown. Each of the combustor apparatuses 30 forming part of combustion section 14 may be constructed in the same manner as the combustor apparatus 30 illustrated in FIG. 2. Hence, only the combustor apparatus 30 illustrated in FIG. 2 will be discussed in detail here.

The combustor apparatus 30 comprises a combustor casing 60, a liner 64 coupled to a cover plate 66 via a plurality of liner support structures 68, a primary fuel injection system 70, also referred to herein as a first fuel injection system, a secondary fuel/air injection system 72, also referred to herein as a second fuel injection system, and the corresponding transition duct 32A.

In the illustrated embodiment, an annular gap 80 is formed between the combustor casing 60 and the liner 64. Compressed air supplied from the compressor section 12 to the combustor shell 28 enters the combustor apparatus 30 through the annular gap 80. As the compressed air approaches the cover plate 66, it turns 180 degrees and flows toward a main combustion zone 82 defined by a portion of the liner 64. As will be described in detail herein, a first portion of this compressed air is delivered to the primary fuel injection system 70 and a second portion of this compressed air is delivered to the secondary fuel/air injection system 72.

As shown in FIG. 2, the primary fuel injection system 70 comprises a pilot nozzle assembly 84 attached to the cover plate 66 and a plurality of main nozzle assemblies 86 also attached to the cover plate 66. In the embodiment shown, eight main nozzle assemblies 86 are provided and are arranged in an annular array about the pilot nozzle assembly 84, although additional or fewer main nozzle assemblies 86 may be included in the primary fuel injection system 70. The pilot and main nozzle assemblies 84, 86 receive fuel from a fuel source $F_S$ (see FIG. 1) and also receive the first portion of the compressed air and distribute the fuel and air to the main combustion zone 82. The fuel and air is ignited in the main combustion zone 82 creating hot combustion gas.

Figure 3:
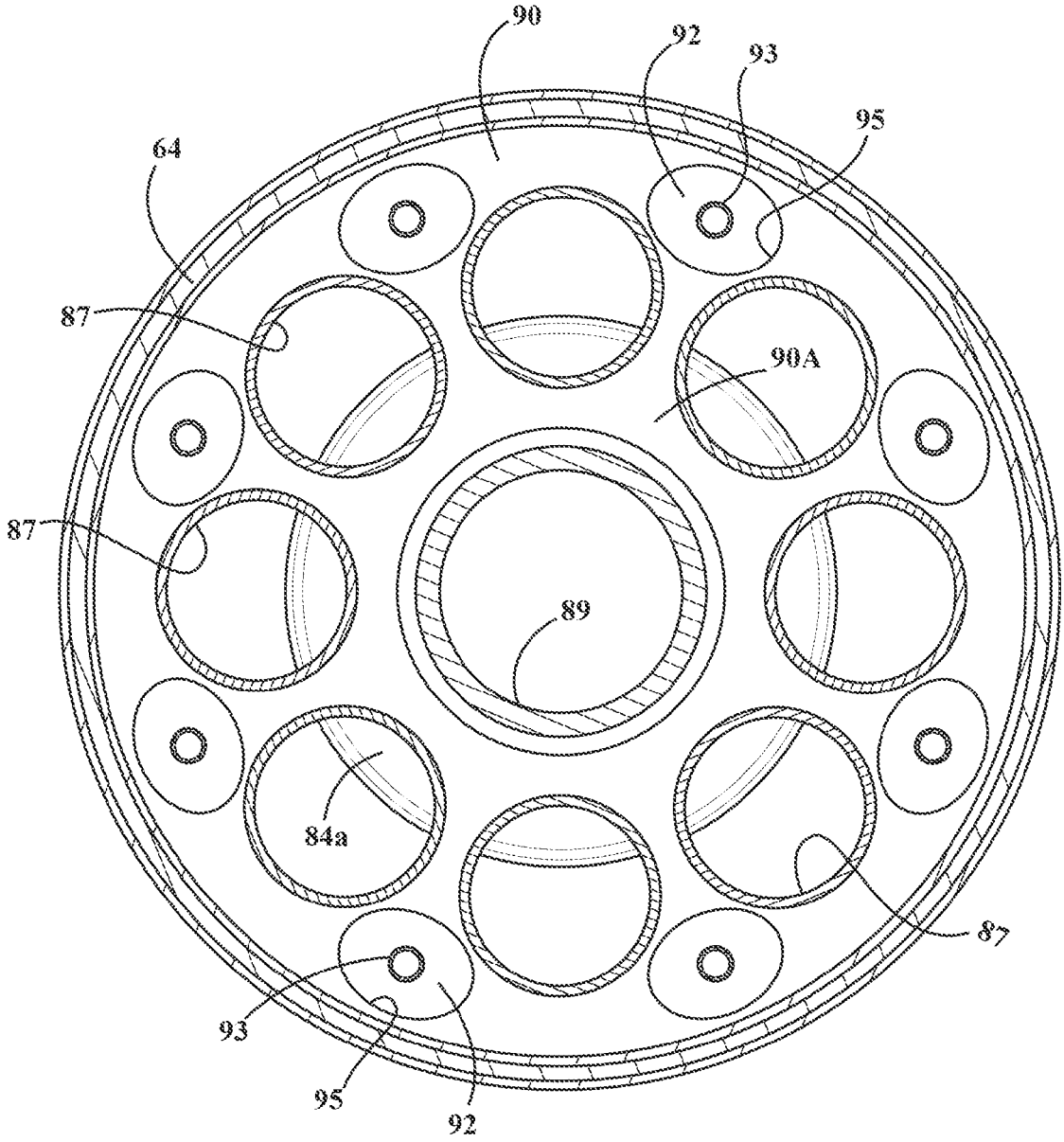
FIG. 3 is a cross sectional view of a base plate taken along line 3-3 in FIG. 2.

A base plate 90, illustrated in FIGS. 2 and 3, is supported by the liner 64, and defines a plurality of apertures 87 (see FIG. 3). An outlet structure 86A, such as a main swirler assembly, is positioned at each aperture 87 for passage of air through the base plate 90 into the main combustion zone 82, and a main fuel nozzle 86B extends through each outlet structure 86A to distribute fuel into the main combustion zone 82. The base plate 90 also includes a central aperture 89 (see FIG. 3) that receives the pilot nozzle assembly 84 therethrough. The pilot nozzle assembly 84 includes a pilot cone 84A for passage of air through the base plate 90 into the main combustion zone 82, and a pilot fuel nozzle 84B extends through the pilot cone 84A to distribute fuel into the main combustion zone 82. A portion 90A of the base plate 90 extending between these apertures 87 and 89 and openings 95 (to be discussed below) substantially blocks additional air from passing into the main combustion zone 82.

In the embodiment shown, the secondary fuel/air injection system 72 comprises a plurality of fuel/air passages 92 extending axially from the base plate 90 through the main combustion zone 82 to a secondary combustion zone 94 located downstream from the main combustion zone 82 see FIG. 2. It is noted that the fuel/air passages 92 are schematically shown in FIG. 2.

Referring to FIG. 3, the secondary fuel/air injection system 72 in the embodiment shown comprises eight fuel/air passages 92 located radially outwardly from the main nozzle assemblies 86. The fuel/air passages 92 are preferably arranged in an annular array and are substantially equally spaced in the circumferential direction. It is noted that the number, size and locations of the fuel/air passages 92 may vary. Further, the fuel/air passages 92 may be configured in other patterns as desired, such as, for example, a random pattern. However, in a preferred embodiment, the fuel/air passages 92 share a common centerline $C_L$ with the main nozzle assemblies 86, see FIG. 2.

The fuel/air passages 92 of the secondary fuel/air injection system 72 include fuel supply tubes 93, illustrated in FIGS. 2 and 3, which fuel supply tubes 93 in the embodiment shown extend from the cover plate 66 and receive fuel from the fuel source $F_S$. The fuel supply tubes 93 in the embodiment shown generally extend to midportions 92C of the fuel/air passages 92 located between inlet and outlet ends 92A, 92B thereof. The fuel supply tubes 93 deliver the fuel from the fuel source $F_S$ into the fuel/air passages 92 at the midportions 92C thereof.

The fuel/air passages 92 also receive the second portion of the compressed air via corresponding openings 95 (see FIG. 3) formed in the base plate 90. The fuel from the fuel supply tubes 93 is mixed with the second portion of air in the fuel/air passages 92 and is delivered from the fuel/air passages 92 to the secondary combustion zone 94 via the outlet ends 92B, which may comprise, for example, nozzle structures. Thus, the first and second portions of the compressed air each pass through the base plate 90 before being delivered to the respective combustion zone 82, 94. The fuel and air from the fuel/air passages 92 is ignited in the secondary combustion zone 94 creating additional hot combustion gas.

As noted above, the fuel/air passages 92 are schematically shown in FIG. 2. The fuel/air passages 92 could comprise any structure capable of conveying the fuel to the secondary combustion zone 94 and delivering the fuel thereto. Also, while the fuel/air passages 92 according to this embodiment extend from the base plate 90, other types of fuel injectors can be used, such as, for example, wherein the fuel injectors extend radially inwardly into the liner 64 through apertures (not shown) in the liner 64 downstream from the main combustion zone 82.

A method of operating a combustor apparatus, such as the combustor apparatus 30 described above with reference to FIGS. 1 and 2, will now be described. Initially, the engine 10 is assumed to be operated at a full load operating mode, also referred to herein as a first operating mode and corresponding to 100% load of the engine 10.

Figure 5:
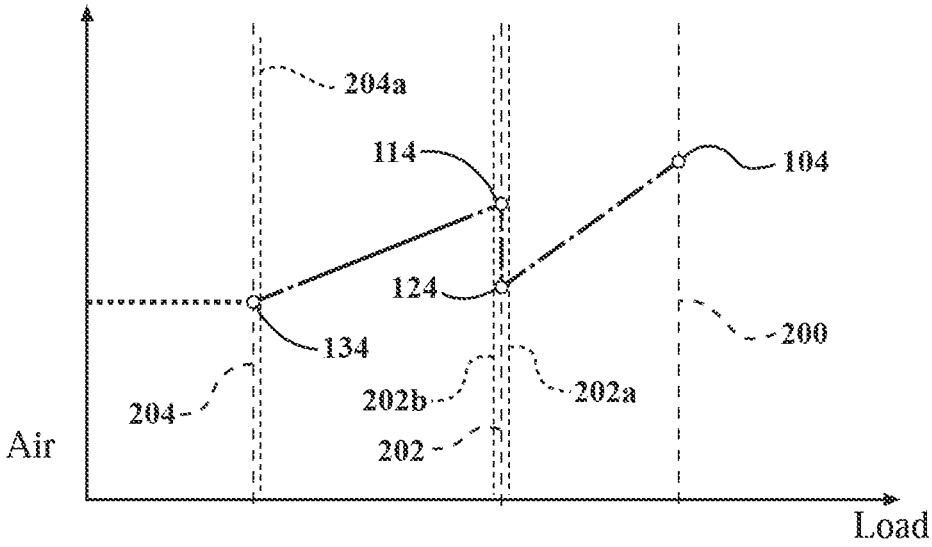
FIG. 5 is a graph illustrating an amount of air delivered to a combustor apparatus according to an embodiment of the invention.

According to one aspect of the invention, during full load operating mode of the engine 10, fuel is delivered to both the primary fuel injection system 70 and the secondary fuel/air injection system 72 and air is delivered to the combustor apparatus 30 according to the graphs illustrated in FIGS. 4 and 5. Full load operating mode is designated by the reference number 200 in FIGS. 4 and 5, where a first amount of fuel, point 100 (FIG. 4), is provided to the primary fuel injection system 70, a second amount of fuel, point 102 (FIG. 4), is provided to the secondary fuel/air injection system 72, and a first amount of air, point 104 (FIG. 5), is provided to the combustor apparatus 30. FIGS. 4 and 5 are presented as dimensionless in that actual values of fuel and air at particular loads will vary depending on the particular system and application, and further in that it is the relative variations between the various described features and/or attributes of operation that are of significance.

The engine 10 is transitioned from the full load operating mode 200 to a part load operating mode, also referred to as a second operating mode and corresponding to, for example, about 50-70% load of the engine 10. The part load operating mode corresponds to a lesser load than the full load operating mode 200. Part load operating mode is designated by the reference number 202 in FIGS. 4 and 5, where a third amount of fuel, point 110 (FIG. 4), is provided to the primary fuel injection system 70, a fourth amount of fuel, point 112 (FIG. 4), is provided to the secondary fuel/air injection system 72, and a second amount of air, point 114 (FIG. 5), is provided to the combustor apparatus 30.

During the transition from the full load operating mode 200 to the part load operating mode 202, the amount of fuel provided to both the primary fuel injection system 70 and the secondary fuel/air injection system 72 is concurrently decreased, i.e., from point 100 to point a 120 lower than the third amount of fuel 110 for the primary fuel injection system 70 and from point 102 to a point 122 greater than the fourth amount of fuel 112 for the secondary fuel/air injection system 72. The amount of fuel provided to the primary fuel injection system 70 and the secondary fuel/air injection system 72 is continuously decreased, such as corresponding linear decreases with a decreasing load as depicted by the graph shown in FIG. 4, until operating parameters corresponding to the part load operating mode 202 are reached. The operating parameters corresponding to or defining the part load operating mode 202 may vary depending upon the particular configuration of the engine 10, but could be, for example, a predetermined CO emission, e.g., as measured at the turbine exhaust 38 by the exhaust sensor(s) 40 (see FIG. 1), a predetermined fuel/air ratio (FAR), a rate of increase of CO emissions, e.g., as measured at the turbine exhaust 38 by the exhaust sensor(s) 40, a percent load based on the full load operating mode 200, etc. The predetermined CO emissions may vary, but in a preferred embodiment may comprise CO emissions greater than about 5 parts per million, volumetric dry (ppmvd) at 15% $O_2$.

Concurrently with reducing the amount of fuel provided to both the primary fuel injection system 70 and the secondary fuel/air injection system 72 during the transition from the full load operating mode 200 to the part load operating mode 202, a total amount of air provided to the combustion section 14 and therefore to the combustor apparatus 30 is reduced i.e., from point 104 to a point 124 lower than the second amount of air 114 in FIG. 5. The amount of air provided the combustor apparatus 30 is continuously decreased, such as a linear decrease with a decreasing load as depicted by the graph shown in FIG. 5, until the operating parameters corresponding to the part load operating mode 202 are reached. Reducing the total amount of air provided to the combustor apparatus 30 may be accomplished, for example, by adjusting the position of the IGVs 18, described above with respect to FIG. 1, to reduce the amount of air permitted to enter the compressor section 12, or by reducing the amount of air provided to the combustor shell 28 of the combustion section 14 (see FIG. 1). By reducing the total amount of air supplied to the combustion section 14 and therefore to the combustor apparatus 30, the first portion of air provided to the primary fuel injection system 70 and the second portion of air provided to the secondary fuel/air injection system 72 are each reduced.

Upon reaching the operating parameters corresponding to the part load operating mode 202, the amount of fuel provided to the primary fuel injection system 70 is increased, as depicted by point 110 in FIG. 4, and the amount of fuel provided to the secondary fuel/air injection system 72 is reduced or discontinued, as depicted by point 112 in FIG. 4. In the preferred embodiment, the amount of fuel increase to the primary fuel injection system 70 is substantially equal to the amount of fuel decrease to the secondary fuel/air injection system 72. Also in the preferred embodiment, the fuel supply to the secondary fuel/air injection system 72 is reduced to a predetermined amount, e.g., zero.

Also upon reaching the operating parameters corresponding to the part load operating mode 202, the total amount of air provided to the combustor apparatus 30 is increased, as depicted by point 114 in FIG. 5. This may be accomplished, for example, by adjusting the position of the IGVs 18 to increase the amount of air permitted to enter the compressor section 12, or by otherwise increasing the amount of air provided to the combustor shell 28 of the combustion section 14. By increasing the total amount of air supplied to the combustion section 14 and therefore to the combustor apparatus 30, the first portion of air provided to the primary fuel injection system 70 and the second portion of air provided to the secondary fuel/air injection system 72 are each increased.

According to another aspect of the invention, the engine 10 may be transitioned from the part load operating mode 202 to a third operating mode corresponding to, for example, less than about 30% load of the engine 10. The third operating mode corresponds to a lesser load than the part load operating mode 202, and is designated by the reference number 204 in FIGS. 4 and 5, where a fifth amount of fuel, point 130 (FIG. 4), is provided to the primary fuel injection system 70, a sixth amount of fuel, point 132 (FIG. 4), is provided to the secondary fuel/air injection system 72 (which, according to this embodiment, is the same as the fourth amount of fuel depicted by point 112 and is zero), and a third amount of air, point 134 (FIG. 5), is provided to the combustor apparatus 30.

During the transition from the part load operating mode 202 to the third operating mode 204, the amount of fuel provided to the primary fuel injection system 70 is decreased from point 110 to point 130 and the amount of fuel provided to the secondary fuel/air injection system 72 is maintained at a predetermined value, e.g., zero. The amount of fuel provided the primary fuel injection system 70 may be continuously decreased, such as a linear decrease with a decreasing load as depicted by the graph shown in FIG. 4, until operating parameters corresponding to the third operating mode 204 are reached. The operating parameters corresponding to the third operating mode 204 may vary, but could be, for example, a predetermined position of the IGVs 18, e.g., wherein the IGVs 18 are in a maximum closed position, a predetermined temperature measured at the turbine exhaust 38, e.g., measured by the one or more exhaust sensors 40, a predetermined FAR, etc.

Concurrently with reducing the amount of fuel provided to the primary fuel injection system 70, the total amount of air provided to the combustor apparatus 30 is reduced from point 114 to point 134, as shown in FIG. 5. The amount of air provided to the combustor apparatus 30 may be continuously decreased, such as a linear decrease with a decreasing load as depicted by the graph shown in FIG. 5, until the operating parameters corresponding to the third operating mode 204 are reached. This may be accomplished, for example, by adjusting the position of the IGVs 18 to reduce the amount of air permitted to enter the compressor section 12, or by otherwise reducing the amount of air provided to the combustor shell 28 of the combustion section 14. By reducing the total amount of air supplied to the combustor apparatus 30, the first portion of air provided to the primary fuel injection system 70 and the second portion of air provided to the secondary fuel/air injection system 72 are each reduced. According to one embodiment, the total air provided for the third operating mode 204 may be substantially equal to total air provided at a time just prior to transitioning to the part load operating mode 202, represented by reference number 202*a* in FIG. 5.

It is noted that the load percentages corresponding to the full load operating mode 200, the part load operating mode 202, and the third operating mode 204 can vary from those as described herein without departing from the spirit and scope of the invention.

Injecting fuel in two fuel injection locations, i.e., via the primary fuel injection system 70 and the secondary fuel/air injection system 72, may reduce the production of NOx by the combustion section 14. For example, since a significant portion of the fuel, e.g., about 15-25% of the total fuel supplied by the primary fuel injection system 70 and the secondary fuel/air injection system 72, is injected in a location downstream of the main combustion zone 82, i.e., by the secondary fuel/air injection system 72, the amount of time that the portion of the combustion gas produced at the secondary combustion zone 94 is at a high temperature is reduced as compared to combustion gas resulting from the ignition of fuel injected by the primary fuel injection system 70. Since NOx production is increased by the elapsed time the combustion gas is at a high combustion temperature, combusting a portion of the fuel downstream of the main combustion zone 82 reduces the time the combustion gas resulting from the fuel provided by the secondary fuel/air injection system 72 is at a high temperature, such that the amount of NOx produced by the combustion section 14 may be reduced.

Figure 6:
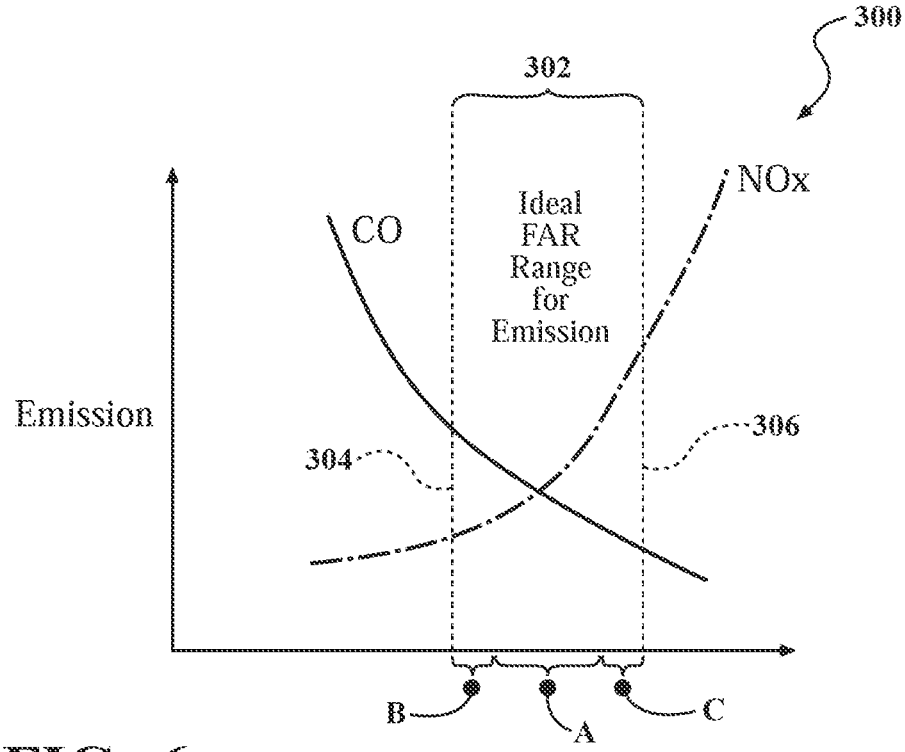
FIG. 6 is a graph plotting fuel/air ratios vs. emissions achieved in a gas turbine engine according to an embodiment of the invention.

Further, the temperature of the combustion gas can be reduced by leaning out the fuel/air mixture, corresponding to a reduction in the fuel/air ratio (FAR). Since lowering the temperature of the combustion gas effectively reduces NOx emissions, reducing the FAR with a corresponding reduction in the temperature of the combustion results in a reduction in NOx emissions. However, if the temperature of the combustion gas becomes too low, carbon monoxide (CO) emissions may increase, wherein the CO emission rate of the combustion gas may exceed an acceptable level. In order to maintain acceptable emission rates for both NOx and CO, a target range for the FAR is provided, as illustrated in FIG. 6. FIG. 6 is presented as dimensionless in that actual values of fuel/air ratios and emissions resulting therefrom will vary depending on the particular system and application, and further in that it is the relative variations between the various described features and/or attributes of operation that are of significance.

FIG. 6 illustrates a graph 300 plotting CO and NOx emissions corresponding to FARs associated with operation of the engine 10. According to the above aspects of the invention, the FAR provided by the combustor apparatus 30 according to the method described above is preferably kept within an ideal range 302, located between a lower limit 304 and an upper limit 306, as will now be described.

At full load operating mode 200, as described above, the combustor apparatus 30 may be operated with the FAR in a portion of the ideal range 302, depicted by range A in FIG. 6. Hence, both NOx and CO emissions are at acceptable levels during the full load operating mode 200.

As the engine 10 is transitioned from the full load operating mode 200 to the part load operating mode 202, the amount of fuel provided to both the primary fuel injection system 70 and the secondary fuel/air injection system 72 is decreased and the total amount of air provided to the combustor apparatus 30 is reduced, as described above. Just prior to this transition, the FAR for combustor apparatus 30 may approach the lower limit 304, as depicted by range B in FIG. 6, which may correspond to operation of the turbine at a point 202*a* (see FIGS. 4 and 5) just prior to reaching the part load operating mode 202.

As the FAR reaches the lower limit 304, or, more preferably, prior to the FAR reaching the lower limit 304, the operating parameters corresponding to the part load operating mode 202 are met, at which point the fuel provided to the primary fuel injection system 70 is increased and the fuel provided to the secondary fuel/air injection system 72 is reduced or discontinued, as described above. Concurrently, the total amount of air provided to the combustor apparatus 30 is increased, also described above. During these steps, the FAR for combustor apparatus 30 may increase and approach the upper limit 306, as depicted by range C in FIG. 6, which may correspond to operation of the turbine at a point 202*b* (see FIGS. 4 and 5) just after transitioning to the part load operating mode 202. By increasing the total amount of air provided to the combustor apparatus 30, the first portion of air provided to the main fuel injection system 70 is effectively increased, which may prevent the main combustion zone 82 from becoming too rich (as a result of the increased amount of fuel being provided to the primary fuel injection system 70), with a resulting FAR above the upper limit 306, which could otherwise lead to excessive NOx emissions. Thus, the FAR is maintained within the ideal range 302 during the transition from the full load operating mode 200 to the part load operating mode 202 and also during the part load operating mode 202.

In some instances, it is desirable to maintain the engine at the part load operating mode 202. In other instances, it may be desirable to further reduce the load of the engine 10, i.e., by transitioning from the part load operating mode 202 to the third operating mode 204. Even during transition from the part load operating mode 202 to the third operating mode 204, the FAR is maintained in the ideal range 302. Specifically, as the amount of fuel provided to the primary fuel injection system 70 is reduced, the total amount of air provided to the combustor apparatus 30 is also reduced, thus preventing the FAR of the combustor apparatus 30 from exceeding the lower and upper limits 304 and 306. Just prior to reaching the third operating mode 204, which may correspond to operation of the turbine at a point 204*a* (see FIGS. 4 and 5), the FAR for combustor apparatus 30 may approach the lower limit 304 and fall into the range B in FIG. 6.

It is noted that the third operating mode 204 corresponds to a maximum closed position of the IGVs 18, wherein the total amount of air provided combustor apparatus 30 may not be able to be further reduced. Hence, reducing the amount of fuel provided to the primary fuel injection system 70 any further may result in the FAR falling below the lower limit 304 and a corresponding increase in CO emission above an acceptable value. It is also noted that in FIGS. 4 and 5, the dotted portions of the graphs to the left of the third operating mode 204 represent operation of the engine 10 in a FAR range outside of desirable limits.

It may also be noted that during operation at part load operation at the part load operating mode 202 and during the transition from the part load operating mode 202 to the third operating mode 204, a second portion of air is distributed to the secondary combustion zone 94, thus effectively reducing the percentage of total air supplied for combustion in the combustor apparatus 30, i.e., only the first portion of air is supplied for combustion in the main combustion zone 82 and the secondary combustion zone 94 is effectively "turned off", as no fuel is provided thereto from the secondary fuel/air injection system 72. Hence, a reduced total amount of fuel may be provided to the combustor apparatus 30, as determined relative to the first portion of air, to provide additional turndown capability during part load operation.

With this control strategy, the turndown capability of the engine 10 may be increased while maintaining the FAR within the ideal range 302 and thus maintaining NOx and CO at acceptable levels.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of operating a combustor apparatus in a turbine engine comprising:

transitioning from a first operating mode to a second operating mode corresponding to a lesser load than the first operating mode, the method comprising:

reducing an amount of fuel provided to a primary fuel injection system of the combustor apparatus, the primary fuel injection system providing fuel to a main combustion zone;

reducing an amount of fuel provided to a secondary fuel/air injection system of the combustor apparatus, the secondary fuel/air injection system providing fuel to a secondary combustion zone downstream from the main combustion zone;

reducing a total amount of air provided to the combustor apparatus, wherein a first portion of the air is provided to the primary fuel injection system and a second portion of the air is provided to the secondary fuel/air injection system; upon reaching operating parameters corresponding to the second operating mode:

increasing the amount of fuel provided to the primary fuel injection system;

reducing the amount of fuel provided to the secondary fuel/air injection system to a predetermined value;

increasing the total amount of air provided to the combustor apparatus;

maintaining an air to fuel ratio in the combustion zone which is ideal for reducing carbon monoxide (CO) and nitrous oxides (NOx) emissions during the first operating mode, the second operating mode and the transition from the first to the second operating mode;

transitioning from the second operating mode to a third operating mode corresponding to a lesser load than the second operating mode;

reducing the amount of fuel provided to the primary fuel injection system during the transition from the second operating mode to the third operating mode;

maintaining the amount of fuel provided to the secondary fuel/air injection system at the predetermined value during the transition from the second operating mode to the third operating mode; and continuously reducing the total amount of air provided to the combustor apparatus during the transition from the second operating mode to the third operating mode.

2. The method of claim 1, wherein increasing the amount of fuel provided to the primary fuel injection system comprises increasing the amount of fuel provided to the primary fuel injection system by substantially the same amount as the secondary fuel/air injection system is reduced to the predetermined value.

3. The method of claim 1, wherein reducing the amount of fuel provided to the secondary fuel/air injection system comprises reducing the amount of fuel provided to the secondary fuel/air injection system to substantially zero.

4. The method of claim 1, wherein the operating parameters corresponding to the second operating mode comprise a predetermined fuel/air ratio in the main combustion zone.

5. The method of claim 1, wherein the operating parameters corresponding to the second operating mode comprise a predetermined amount of CO emitted from the turbine engine.

6. The method of claim 5, wherein the predetermined amount of CO emitted from the turbine engine comprise CO emissions greater than about 5 ppmvd at 15% $O_2$.

7. The method of claim 1, wherein:

reducing the total amount of air provided to the combustor apparatus comprises maneuvering at least one inlet guide vane to permit less air into the turbine engine; and increasing the total amount of air provided to the combustor apparatus comprises maneuvering at least one inlet guide vane to permit more air into the turbine engine.

8. The method of claim 1, wherein:

reducing the total amount of air provided to the combustor apparatus comprises reducing the amount of air provided to a combustor shell of the combustor apparatus; and increasing the total amount of air provided to the combustor apparatus comprises increasing the amount of air provided to the combustor shell.

9. The method of claim 1, wherein the combustor apparatus comprises a base plate, and air delivered to the main and secondary combustion zones passes through the base plate.

10. The method of claim 1, wherein air is provided to both the primary fuel injection system and the secondary fuel/air injection system during the first and second operating modes.

11. The method of claim 1, further comprising maintaining CO emissions of the turbine engine below about 10 ppmvd at 15% $O_2$ during both the first and second operating modes.

12. A method of operating a combustor apparatus in a turbine engine comprising:

transitioning from a full load operating mode to a part load operating mode, the method comprising:

reducing an amount of fuel provided to a primary fuel injection system of the combustor apparatus, the primary fuel injection system providing fuel to a main combustion zone;

reducing an amount of fuel provided to a secondary fuel/air injection system of the combustor apparatus, the secondary fuel/air injection system providing fuel to a secondary combustion zone downstream from the main combustion zone;

continuously reducing a total amount of air provided to the combustor apparatus during the transition from the full load operating mode to the part load operating mode, wherein a first portion of the air is provided to the primary fuel injection system and a second portion of the air is provided to the secondary fuel/air injection system, the second portion of air being distributed to the secondary combustion zone via at least one outlet of the secondary fuel/air injection system located at the secondary combustion zone;

upon reaching operating parameters corresponding to the part load operating mode:

increasing the amount of fuel provided to the primary fuel injection system;

reducing the amount of fuel provided to the secondary fuel/air injection system to a predetermined value;

increasing the total amount of air provided to the combustor apparatus;

maintaining an air to fuel ratio in the combustion zone which is ideal for reducing carbon monoxide (CO) and nitrous oxides ($NO_x$) emissions during the full load operating mode, the part load operating mode and the transition from the full load to the part load operating mode.

13. The method of claim 12, wherein increasing the amount of fuel provided to the primary fuel injection system comprises increasing the amount of fuel provided to the primary fuel injection system by substantially the same amount as the secondary fuel/air injection system is reduced to the predetermined value.

14. The method of claim 12, wherein reducing the amount of fuel provided to the secondary fuel/air injection system comprises reducing the amount of fuel provided to the secondary fuel/air injection system to substantially zero.

15. The method of claim 12, wherein the operating parameters corresponding to the part load operating mode comprise a predetermined amount of CO emitted from the turbine engine.

16. The method of claim 12, wherein:

reducing the total amount of air provided to the combustor apparatus comprises maneuvering at least one inlet guide vane to permit less air into the turbine engine; and increasing the total amount of air provided to the combustor apparatus comprises maneuvering at least one inlet guide vane to permit more air into the turbine engine.

17. The method of claim 12, wherein the combustor apparatus comprises a base plate, and air delivered to the main and secondary combustion zones passes through the base plate.

18. The method of claim 12, wherein air is provided to both the primary fuel injection system and the secondary fuel/air injection system during both the full load and the part load operating modes.

19. The method of claim 12, wherein the secondary fuel/air injection system comprises fuel/air passages extending through the main combustion zone and including fuel supply tubes providing fuel to midportions of said fuel/air passages between an inlet end and an outlet end of said fuel/air passages.

* * * * *